United States Patent [19]

Young

[11] 4,075,769

[45] Feb. 28, 1978

[54] METHOD AND ARTICLE FOR WEIGHT REDUCTION

[76] Inventor: Julius Young, 2759 Mackintosh, Bloomfield Hills, Mich. 48013

[21] Appl. No.: 607,213

[22] Filed: Aug. 25, 1975

[51] Int. Cl.[2] ..... G09B 19/00

[52] U.S. Cl. ..... 35/1; 33/174 T; 40/324; 220/23.8

[58] Field of Search ..... 35/1, 8 R, 29 E, 7 R, 35/7 A; 33/174 T; 220/83, 23.8; D7/23, 26, 27; 40/324

[56] References Cited

U.S. PATENT DOCUMENTS

| | | | |
|---|---|---|---|
| Re. 24,575 | 12/1958 | Costanzo | 220/83 |
| 28,693 | 6/1860 | Shirley | 220/23.8 |
| D. 166,934 | 6/1952 | Slobodkin | D7/23 |
| D. 190,825 | 7/1961 | Anderson | D7/36 |
| D. 194,054 | 11/1962 | Grossman | D7/27 |
| D. 200,867 | 4/1965 | Haifley | D7/27 |

*Primary Examiner*—William H. Grieb
*Attorney, Agent, or Firm*—Harness, Dickey & Pierce

[57] ABSTRACT

A method for weight reduction which permits a person to be served and eat as much food as he wants. The method centers around the concept of reducing each portion of food picked up with the utensil to a predetermined maximum size before placing it in the mouth. An article for use in conjunction with the method comprises a plate having a relatively large area for the meal and at least one smaller area alongside the large area to which the person eating must reduce each mouthful of food before it is ingested.

3 Claims, 3 Drawing Figures

METHOD AND ARTICLE FOR WEIGHT REDUCTION

BACKGROUND OF THE INVENTION

1. Field of the Invention

The invention relates to weight reduction, and more particularly to a method and means for reducing food intake based on the concept of behavior modification.

2. Description of the Prior Art

Countless methods and devices have been proposed in the past for weight reduction. These range from lists of types and quantities of foods to be eaten, schedules of eating times, exercise, hypnosis and a wide variety of other systems. Almost all of these prior methods require that the patient resolve in advance to deny himself certain types or amounts of food, or carry out physical activities above and beyond his or her normal routine. Because of this, persons practicing these prior methods, although they may initially lose weight, are apt to regain the excess weight when they revert to their normal routine habits.

BRIEF SUMMARY OF THE INVENTION

It is an object of the present invention to provide a novel method and article for weight reduction which will, in a subtle yet effective way, change the normal behavior of the patient by instilling eating habits which will not only reduce weight but have a much greater likelihood of retaining the weight loss, because the patient will develop ingrained modes of food consumption which are consistent with bodily health and other normal daily activities.

It is another object to provide an article for the carrying out of this method which is interesting and attractive in appearance and will contribute to the enjoyment of the steps which the patient carries out in the weight reduction plan.

Briefly, the method comprises the steps of providing a plate having a relatively large area marked off for a meal and at least one small adjacent measuring area, picking up a portion of the meal with a utensil, matching said portion against said measuring area, reducing said portion if necessary until the portion is no larger than the measuring area, and ingesting the portion as so reduced.

In another aspect, the invention comprises an article for use in weight reduction comprising a plate having a large area marked off for a meal and at least one substantially smaller measuring area adjacent the meal area, said measuring area being distinctively marked to permit easy reduction of the size of each portion of the meal picked up.

DESCRIPTION OF THE PREFERRED EMBODIMENT

Figure 1:
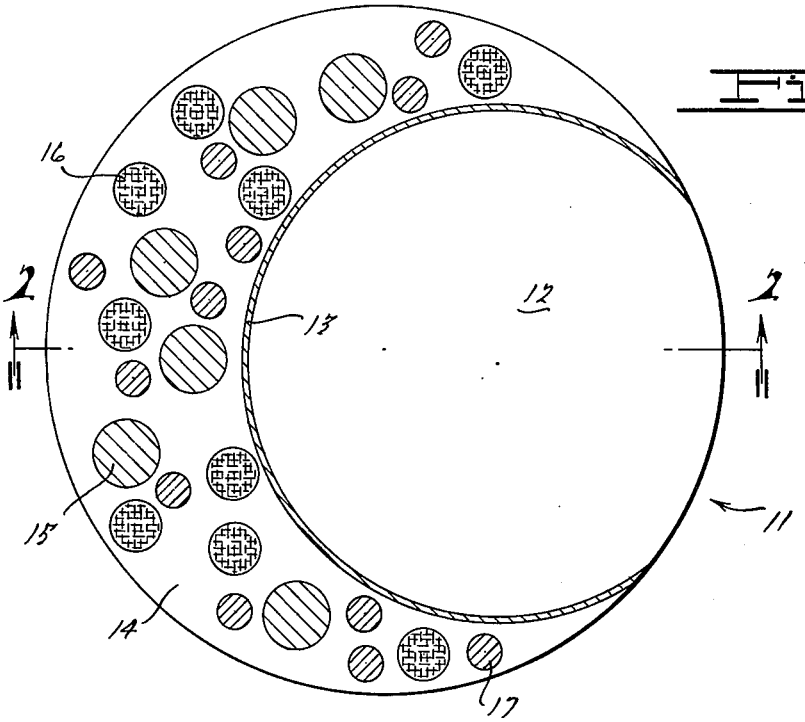
FIG. 1 is a top plan view of a plate embodying the invention.
Figure 2:
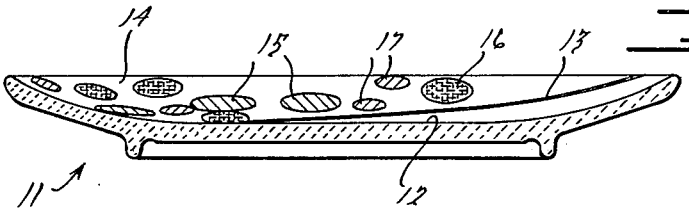
FIG. 2 is a side cross-sectional view thereof taken along the line 2—2 of FIG. 1.
Figure 3:
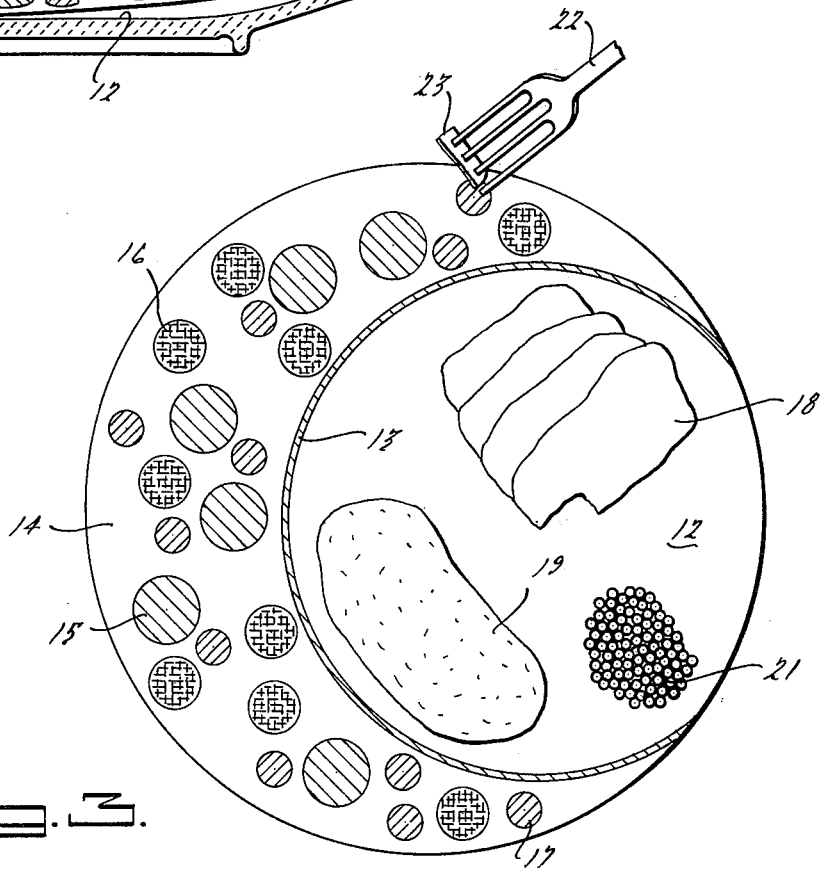
FIG. 3 is a plan view of the plate showing it being used in accordance with the method of this invention.

According to the method of this invention, the person desiring to lose weight serves himself or is served as much food as desired, whether it be a complete meal or a snack. The food is placed on a plate having a relatively large area designated for the entire portion of food to be consumed at the sitting. The plate is also provided with at least one relatively small area which is clearly designated and visible to the individual. The person takes the eating utensil, for example a fork, and picks up some food. He then moves the fork directly over the smaller measuring area, and checks to see whether the amount of food he has picked up is substantially larger than this area. If it is, he reduces the quantity or amount of the food picked up. When the food picked up is of the proper size, the food is ingested. The person eating continues this process either until he feels he has had a sufficiency, or the meal is entirely consumed.

It is well known that a certain amount of time is necessary for the bloodstream to begin to absorb those components of ingested food which, when sensed by certain portions of the nervous system or brain, will create a feeling of satiation in the person eating. If large mouthfuls are ingested, a relatively great amount of food may be consumed before this lessening of hunger is noted. On the other hand, if each mouthful is only a moderate or small amount of food, and if the mouthfuls are taken at the same rate, the person eating will feel satisified after having ingested a lesser total amount of food. Over a period of time the person's weight may thus be reduced in a natural, gradual and healthful manner, and without the need for any forced restrictions or changes in habit which could be psychologically disturbing and difficult to maintain.

Furthermore, continued conscious practice of this method for a reasonable period of time could often result in the person's ability to practice the same method unconsciously, even though the plate having the designated small measuring area or areas is not present. Thus, a person using the method at home where the special plate is available could very well find that after awhile, even when eating in restaurants with conventional plates, he would take only small mouthfuls of food at a time. Thus, the benefits of the method would accrue because the person's behavior had been modified by the method as previously practiced.

The drawings illustrate a novel article by means of which the method of this invention may be carried out. The plate is generally indicated at 11 and is of a round, shallow concave shape. The plate has a relatively large area 12 for the meal to be served, this area being to one side of the plate's center and delineated by an arcuate colored border 13. The crescent shaped area 14 outside of border 13 is provided with a number of relatively small measuring areas. For example, areas 15 could be colored green, somewhat smaller areas 16 colored yellow and still smaller areas 17 perhaps orange or brown. The measuring areas are shown as being circular and are arranged in a pleasing pattern.

In using article plate 11 to carry out the method of this invention, a meal is served on area 12. This may consist for example, of slices of meat 18, a potato 19 and peas 21. The person practicing the method picks up his fork 22 and picks up a portion of food 23 to be ingested. He then holds food portion 23 over one of the measuring areas which he selects, such as an area 15. If the portion 23 is the same size as or smaller than area 15 it may be placed in the mouth. Otherwise the portion will be reduced until it is of the proper size. The same procedure will be followed for the rest of the meal. The provision of measuring areas of various sizes gives the person eating some flexibility and variety in the sizes of portions being ingested, depending upon the type of food and other considerations.

What is claimed is:

1. In a weight reduction method, the steps of providing a plate having a relatively large area marked off for a meal and at least one small adjacent measuring area, picking up a portion of the meal such as meat, potatoes or peas with a utensil, matching said portion against said measuring area, reducing the quantity of said portion if necessary by removal of part of said portion until the portion is no larger than the measuring area, and ingesting the portion as so reduced.

2. An article for use in weight reduction comprising a plate having an upwardly facing surface with a large area marked off for a meal and at least one substantially small measuring area adjacent the meal area, said measuring area being distinctively marked to permit easy reduction of the size of each portion of the meal picked up and being no larger than a portion of a meal which may be picked up with an eating utensil, both of said large area and said measuring area being flush with each other and with the surrounding portions of said upwardly facing surface, said plate being circular, said large area being off center so as to form an eccentric area outside the large area, there being a plurality of measuring areas in said eccentric area, all of said measuring areas being flush with each other and with the surrounding portions of said upwardly facing surface, and no larger than a portion of a meal which may be picked up with an eating utensil.

3. An article according to claim 2, said measuring areas being of different sizes and colors.

* * * * *